United States Patent [19]

Hehner

[11] 4,148,444

[45] Apr. 10, 1979

[54] GRIPPING CHUCK FOR SPOOLS

[75] Inventor: Reinhard Hehner, Mulheim, Fed. Rep. of Germany

[73] Assignee: Jagenberg Werke AG, Dusseldorf, Fed. Rep. of Germany

[21] Appl. No.: 921,533

[22] Filed: Jul. 3, 1978

[30] Foreign Application Priority Data

Apr. 8, 1978 [DE] Fed. Rep. of Germany ..... 2815310

[51] Int. Cl.[2] ..... B65H 17/02

[52] U.S. Cl. ..... 242/68.2; 242/72.1

[58] Field of Search ..... 242/68.2, 72, 72.1, 242/68.3, 68.4; 279/2

[56] References Cited

U.S. PATENT DOCUMENTS

| | | | |
|---|---|---|---|
| 2,942,892 | 6/1960 | Nelson | 242/72.1 |
| 3,704,837 | 12/1972 | Heinz | 242/68.2 |
| 3,881,666 | 5/1975 | Greenbalgh | 242/68.2 |

*Primary Examiner*—Edward J. McCarthy

*Attorney, Agent, or Firm*—Sprung, Felfe, Horn, Lynch & Kramer

[57] ABSTRACT

A chuck for use with spools comprises a shaft and at least one inner wedge-shaped member mounted to one end of the shaft for axial movement and biased away from the shaft. A gripper comprises at least two outer members slidably mounted on the inner members to effect movement radially outwardly to thereby grip the inside of the spool. A first stop is connected to the gripper and engageable with the outer edge of the spool to limit the movement thereof with respect to the outer members and movable with respect to the inner member and a second stop is connected to the shaft for engaging with the outer members to limit their axial movement against the force of the bias.

5 Claims, 4 Drawing Figures

GRIPPING CHUCK FOR SPOOLS

BACKGROUND OF THE INVENTION

The invention concerns a gripping chuck for a spool with inner wedge-shaped member which is axially movable against the force of a pressure element and borne by a shaft end and which supports outer shell-like members which constitute gripping jaws that are clampable in the radial direction.

Chucks of this type are known as shown in German Pat. No. Des. 77 10 804. In the known chucks, a diaphram assembly under gas pressure constantly acts on movable wedge-shaped parts in the axial direction, so that the gripping jaws remain constantly tightened in the radial direction. This diaphragm assembly makes the chuck costly, because space must be provided for such assembly and the feeder lines for same. Moreover, it is particularly disadvantageous that the tightening of the gripping jaws by means of the pressure gas can take place only after the spool has been slid onto the chuck. The operating personnel thus have to perform successive specific steps, e.g. sliding on the spool, thereafter introducing the pressure gas and then clamping off the source of the pressure gas.

SUMMARY OF THE INVENTION

The object of the present invention is to provide a chuck for spools which will perforce cause the tightening of the jaws with the sliding on of the spool. At the same time, it must be assured that in the tightened final state the spool is always in the same axial end position, so that no correcting positioning will be necessary after the spool is put on. Exact axial alignment of the spool is essential to the winding of the lengths of material. An example of the use of this type of chuck can be seen in U.S. application Ser. No. 900,689, filed Apr. 27, 1978.

According to the present invention, this object is attained by a chuck comprising at least two outer shell-like members constituting the clamping jaws and having a stop thereon for the spool and that together with the stop they are axially movable on the surface of at least one inner wedge-shaped element which is axially movable against the force of a pressure element and limited by a fixed stop. In accordance with the invention, the clamping jaws and the outer shell-like members may comprise two different structural elements, with ring segments provided for the respective jaws, whereby the outer shell-like members are provided with stops and are axially movable between the ring segments and the inner wedge-shaped member. In the preferred embodiment, the clamping jaws and the appropriate shell-like member are integrated into one structural element.

More specifically, the chuck comprises, in section from inside towards the outside, in an especially preferred embodiment, the inner wedge-shaped member situated on the shaft-end, and axially movable along the length of the shaft. The common surface between the inner wedge-shaped members and the outer shell-like members has a conical shape with a polygonal section. A hexagon or octagon has proved particularly suitable. The outer shell-like members are expediently pressed together in the radial direction by means of a tension spring arranged in a ring-groove therein. Each of the outer shell-like members is preferably supported by two adjoining surfaces of the inner wedge-shaped members. The interior surface of the outer shell-like members is in the form of a "barn roof". The tangential distance of the outer members from one another changes as a result of its axial movement on the inner wedge-shaped elements.

According to a particularly preferred specific embodiment, the axial movement of the inner member in the direction of the force of the pressure element is limited by an adjusting device. A pressure spring is particularly suited to be the pressure element and a bolt screwable into the shaft is particularly suited to serve as the adjusting device. The adjusting device serves to prestress the pressure element and simultaneously set the radial distance of the jaws. In addition, the adjusting device, in combination with a cap-like cover, can serve to limit the axial movement of the outer members. For this, a specific embodiment is eminently suitable, in which the cover has a base through which the adjusting bolt is pressed and which has a radially overhanging rim which limits the movement of the outer members in the direction of the force of the pressure element. The pressure element, in particular a pressure spring, may be arranged, between the bolt and the inner member and bounded by the shaft end and the base of the cover. In a particularly advantageous specific embodiment, the pressure element is arranged in a cavity in the end of the the shaft. The adjusting device comprising the screw bolt is appropriately guided through this pressure spring and is adjustable by means of a thread inside the shaft end and with its bolt head it causes prestressing of the pressure spring by way of the cover base. The cover base itself, however, is axially movable relative to the bolt. Thus depending on the tension applied, the bolt head is free or lies against the cover base. Therefore, in the prestressed state before subjecting the pressure spring to tension, the bolt head will lie against the cover base. When the cover base is moved by the inner member against the pressure spring (tension state), the bolt head will be free and will be at an axial distance form the cover base.

In the chuck according to the present invention, the following advantages are combined in a simple and compact design: Through an axial movement with the spool, automatic tensioning is obtained without the need for an activating device for pressure gas or the like. In the chuck, the clamping jaws are concentrically pressure radially outwardly, so that the centering of the spool is assured. At the same time it is obtained that with axially movable outside clamping jaws, the spool will always be aligned in exactly the same axial position. As the clamping elements are under the influence of the pressure element, a tolerance compensation is always possible, even in the exactly aligned axial position. It is not necessary, therefore, to have spools with exactly calibrated inside diameters, which would make special processing necessary given the present state of the art.

BRIEF DESCRIPTION OF THE DRAWINGS

The present invention will be better understood in view of the following when taken with the drawings which show the invention by way of example and wherein.

DETAILED DESCRIPTION OF THE INVENTION

Figure 1:
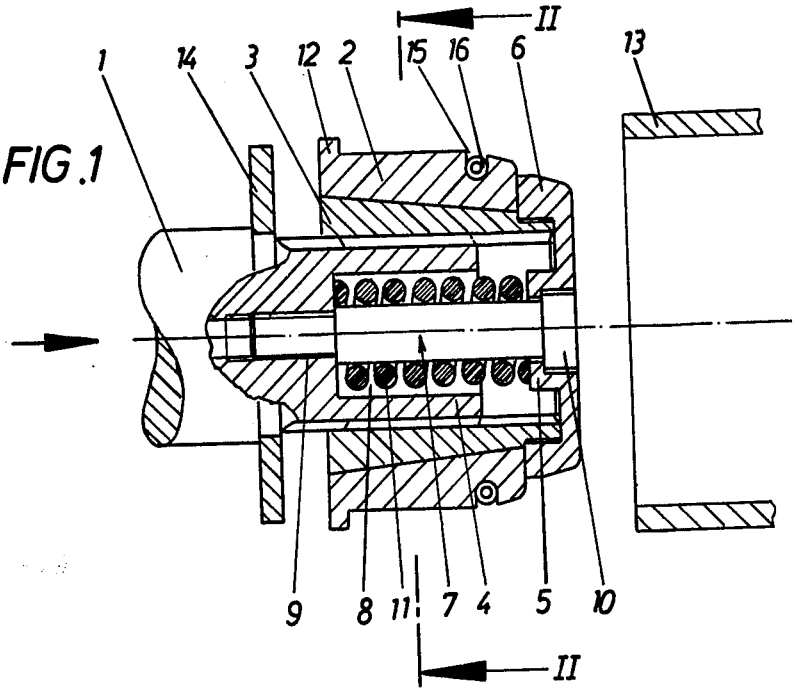
FIG. 1 is a longitudinal section through a chuck according to the present invention.
Figure 3:
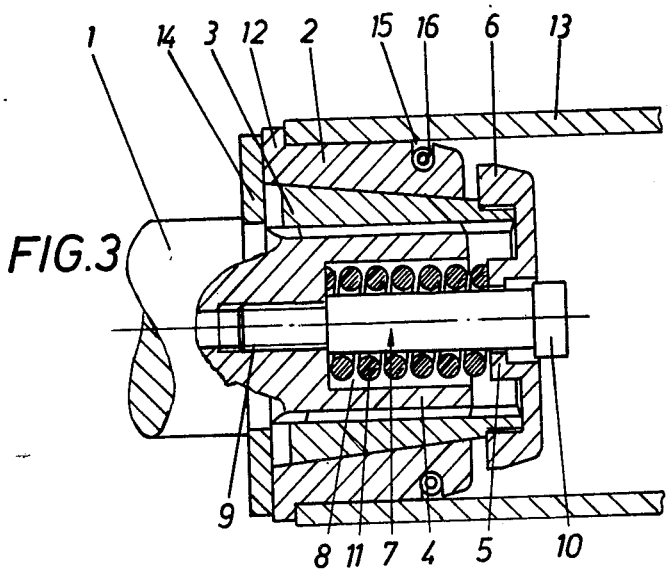
FIG. 3 is a longitudinal section through the chuck of FIG. 1 with the spool mounted.
Figure 2:
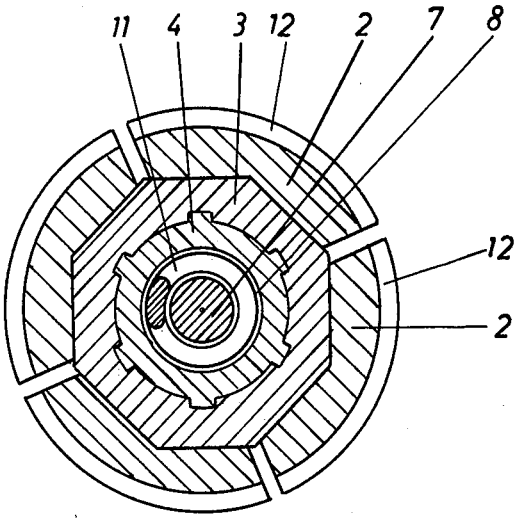
FIG. 2 is a cross-section along II—II of FIG. 1.

Referring now to FIGS. 1 and 3, the chuck connected to shaft 1 comprises, when viewed radially from outside in, of the outer shell-like members 2, at least one inner wedge-shaped member 3 and the shaft end 4. To accept a pressure element 11, the end 4 of shaft 1 has an axially extending cavity 8. In the embodiment shown, the inner member 3 comprises a one-piece hollow cone having an octagonal outer cross-section. The inner wedge-shaped member 3 is connected to the shaft end 4 by way of a splined inner profile which enables only axial movement with respect to the shaft end 4.

A cap-like cover is attached to the shaft end 4 and which has the base 5 at the central portion and a rim 6 at the periphery. Base 5 and rim 6 have stop surfaces which are perpendicular to the axis of the cover and shaft. An adjusting device comprising screw bolt 7 is guided centrally through a hole in the base 5. The screw bolt 7 extends through the cavity 8 and is engaged in an internally threaded bore 9 and is thus movable axially in shaft end 4 when rotated. The head 10 of bolt 7 rests against the base 5 and prior to pushing the spool 13 over base 5, it subjects to tension the pressure element comprising a pressure ring arranged in cavity 8.

On the inner members 3, four outer members 2 are arranged in an axially movable manner. Each of the outer members 2 has an inner surface having an obtuse-angled "barn roof" shape, so that an outer member 2 will be supported by two surfaces of the inner member 3. The tangential distance of the outer members 2 varies in relation to the axial movement. Each of the outer members 2 has a radially outward extending stop flange 12 at the end nearest to the shaft. The spool 13 can rest against stop 12. The axial movement of the outer members 2 in the longitudinal direction of shaft 1 is restricted by flange stop 14 attached to shaft 1. The axial movement of the outer members towards the right in FIGS. 1 and 3 is restricted by the overhanging rim 6 and the cap rim 6 is attached to the inner member 3. The outer members 2 have a ring groove 15 which is preferably arranged in the right half of the outer members 2 and a tension spring 16 is arranged in the ring groove 15. The tension spring 16 presses the outer members 2 together radially and thus acts to urge them axially in the direction of rim 6 due to the inclined surface between the outer and inner members.

Figure 4:
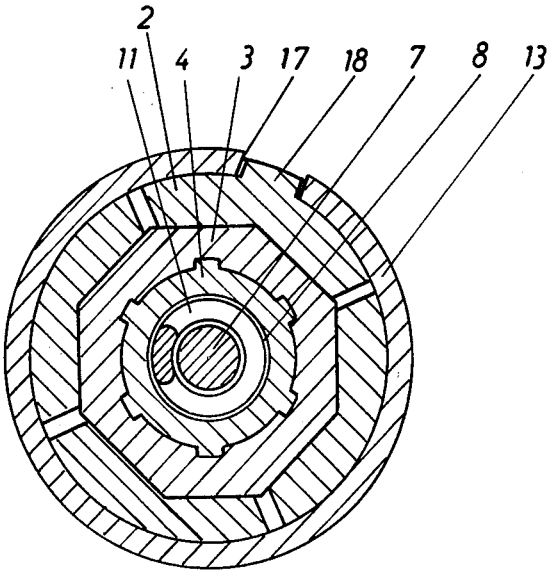
FIG. 4 is a cross-section view of an alternative embodiment for spools and intended for transmitting a moment.

In the alternative specific embodiment shown in FIG. 4, at least one of the outer members 2 has an outwardly extending cam 18. The spool 13 has a groove 17, so that the spool can be slid onto cam 18. Cam 18 and groove 17 engage each other, so that moments are transferable between shaft end 4 and spool 13. This design is suitable, for example, for unwinding processes, in order to transfer a braking force from the chuck to the spool 13.

The method of operation of the chuck according to the invention is as follows: In the starting position of FIG. 1 with the spool 13 not mounted, the outer members 2 rest against the overhanging cap 6 attached to the inner member 3. Depending on the inside diameter of the spool, the screw bolt 7 is moved so that the outside diameter of the clamping jaws, which corresponds to the outside diameter of the outer members 2, will be a few millimeters less than inside diameter of the spool 13. The deeper the bolt 7 is screwed into the shaft, the shorter becomes the relative moving path of both inner and outer members relative to each other, and the shorter will be the radial path required for tension.

When the spool 13 is slipped on, it rests against stop 12 of the outer members 2. Through the relative axial movement of the spool in the direction of the fixed stop 14, the outer members slide on the inner member 3 and thus cause radial tension. As soon as the outer members 2 come to rest adjoining the inner surface of the spool 13, there also occurs an axial movement of the inner member 3 in the direction of the fixed stop 14. This axial movement is against the force of pressure spring 11, because the inner member 3 rests against the pressure spring over the base 5. In this movement, the base 5 moves away from the head 10 of bolt 7. After a spring path, which is determinable in advance, the outer members 2 arrive with their stop flange 12, arranged at their left-side edge, at the fixed stop 14. The axial position of the spool is thus always exactly determined by the fixed stop 14. At the same time, the outer members 2 are under pressure from the spring 11 when they are in this position, because the pressure spring 11 effects a radial pressure of the outer members 2 against the spool 12, over the base 5 and the inner member 3, and because the spring pressure is no longer limited by bolt head 10, so that the clamping jaws are constantly under pressure of the radial force and can readjust themselves automatically.

It will be appreciated that the instant specification and claims are set forth by way of illustration and example, and that modifications and changes may be made thereto without departing from the spirit and scope of the present invention.

What is claimed is:

1. A chuck for use with spools comprising: a shaft; at least one inner wedge-shaped member; means mounting the inner member to one end of the shaft for axial movement and biasing same away from the shaft, gripping means comprising at least two outer members slidably mounted on the inner members to effect movement radially outwardly to thereby grip the inside of the spool; first stop means connected to the gripping means and engageable with the outer edge of the spool to limit the movement thereof with respect to the outer members and movable with respect to the inner member; and second stop means connected to the shaft for engaging with the outer members to limit their axial movement against the force of the bias.

2. The chuck according to claim 1, wherein the mounting means comprises a pressure element and adjustable means for limiting the axial movement of the inner member in the direction of the force of the pressure element.

3. The chuck according to claim 2, wherein the adjusting means comprises a cap having a base in engagement with the pressure element and a rim connected to the outer end of the inner member and extending radially to limit the axial movement of the outer members in the direction of the force of the pressure element.

4. The chuck according to claim 3, wherein the shaft has a cavity in the one end thereof and the pressure element is arranged in the cavity.

5. The chuck according to claim 4, wherein the pressure element comprises a spring, the adjustable means comprises a bolt disposed through the cap base and the spring and is threadably received in the closed end of the cavity to adjustably tension the spring in response to rotation thereof.

* * * * *